United States Patent [19]

Tong

[11] 3,935,665

[45] Feb. 3, 1976

[54] SUBMERSIBLE TOY

[75] Inventor: Duncan Tong, Hong Kong

[73] Assignee: Playart Limited, Hong Kong

[22] Filed: Feb. 12, 1975

[21] Appl. No.: 549,410

[30] Foreign Application Priority Data

Feb. 21, 1974 United Kingdom ..... 08051/74

[52] U.S. Cl. ..... 46/91; 46/92

[51] Int. Cl.² ..... A63H 23/04

[58] Field of Search ..... 46/91, 94

[56] References Cited

UNITED STATES PATENTS

| | | | |
|---|---|---|---|
| 3,010,255 | 11/1961 | Gordon | 46/94 |
| 3,450,908 | 6/1969 | Mabuchi | 46/91 |
| 3,619,938 | 11/1971 | Tong | 46/91 |

*Primary Examiner*—Louis G. Mancene
*Assistant Examiner*—Robert F. Cutting
*Attorney, Agent, or Firm*—Pollock, Vande Sande & Priddy

[57] ABSTRACT

A submersible toy or model comprising a body having a motor arranged to propel it in a forward direction, a watertight buoyancy compartment, and at least one elevator flap which is preset, or capable of being preset, at a downward inclination to the forward direction of movement of the toy, the surface area of the elevator or elevators, the size of the buoyancy compartment, and the power of the motor all being so related that when the model is placed in water with its elevator(s) in the downward position with the motor on, it continually dives and resurfaces.

9 Claims, 1 Drawing Figure

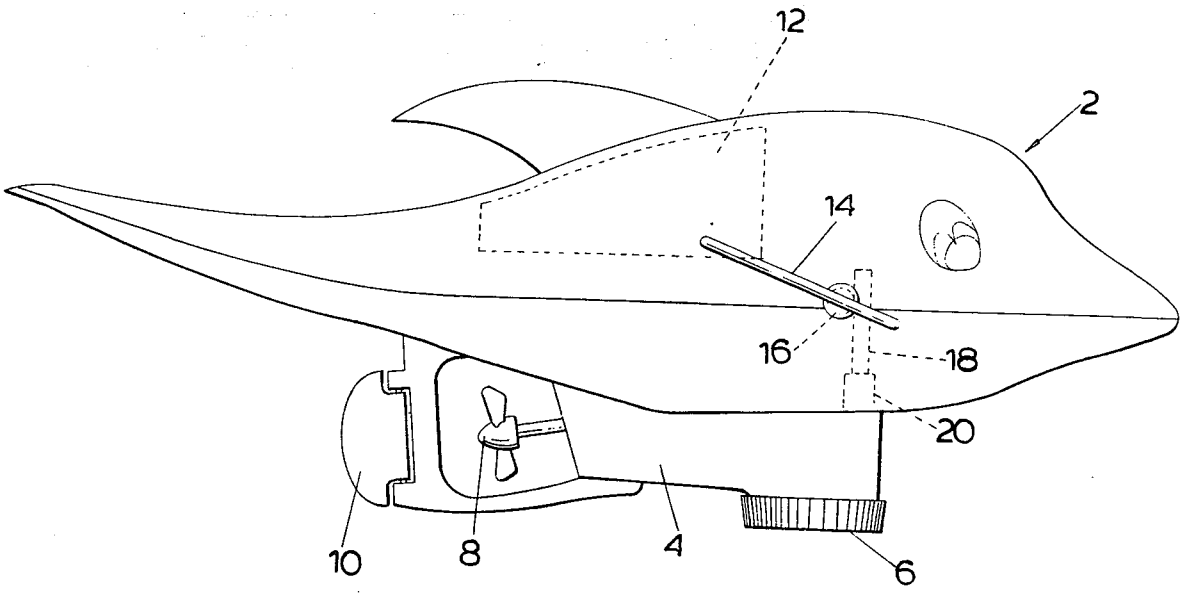
2
12
14
16
18
20
6
4
8
10

SUBMERSIBLE TOY

This invention relates to floating and submersible toys or models.

A submersible toy according to the invention comprises a body having a motor arranged to propel the toy in a forward direction, a watertight buoyancy compartment and at least one elevator flap which is preset or capable of being preset, at a downward inclination to the forward direction. The surface area of the elevator or elevators, and the size of the buoyancy tank, relative to one another and the power of motor are such that when the toy or model is placed in water with its elevator set in a downwardly inclined position and the motor is switched on, the model is first driven down below the surface of the water and then rises to the surface under the influence of the buoyancy tank. This action continues repeatedly.

The toy may be made in the shape of a fish such as a dolphin, in which case the elevators comprise a pair of fins, one on either side of the body near the front end. The buoyancy tank is preferably positioned in the upper part of the body nearer the tail. The motor of the toy is preferably electric and powers a propeller mounted beneath the rear end of the body.

One embodiment of the invention will now be described by way of example with reference to the accompanying drawing which is a side elevation of a toy dolphin in accordance with the invention.

The toy comprises a body 2 having a motor housing 4 which includes an internal compartment(not shown) with a cover 6 for batteries. The cover incorporates a simple rotary switch comprising a contact which is moved, on rotation of the cover, into engagement with one end of a battery to complete the current to the motor. This motor drives a propellor 8 so as to propel the toy in a forward direction.

A rudder 10 can be set so as to determine the path of the toy in the water.

The body has holes in its underside (not shown) to allow water to enter it and also holes in its upper surface to allow air to leave, so that it can submerge, and a watertight compartment 12 which is of sufficient size to float the toy when the remainder of the body is full of water. The compartment 12 is located at the top of the body, somewhat towards the tail.

A pair of elevator fins 14 are located on either side of the body on opposite ends of a rod 16 which passes through the body and is pivotable, so that the fins can be set or selectively fixed at a desired angle to the horizontal. In order to secure the fins in the desired orientation, the rod 16 is provided with a longitudinally-extending ridge (not shown) which engages with a correspondingly corrugated surface (not shown) on an upstanding member 16 mounted inside the body. The member 18 is fixed at its lower end into a socket 20 in the body, and is made of a suitably resilient material so that the angle of the fins 14 can be altered manually against the frictional engagement of the co-operating ridges on the rod 16 and member 18. The retaining action, is, however, sufficient to hold the fins in position against the force of the water.

In use the fins are first moved to the downwardly inclined position illustrated in the drawing. The cover 6 of the battery compartment is rotated to switch on the motor, and the toy held in the water so that the body fills up. The watertight buoyancy compartment holds it on the surface of the water until it gets under way and then, as it moves forward, it is forced beneath the surface by the downward pressure of the water on the elevator fins. After a short distance the buoyancy of the watertight compartment overcomes the downward force and the model again rises to the surface, then dives again. This action continues repeatedly since the toy never reaches a stable state in which the downward thrust on the elevators is exactly balanced by the upthrust caused by the buoyancy tank.

I claim:

1. A submersible toy or model, comprising:

a body member;

a motor and propellor attached to said body member to propel it in a forward direction;

at least one elevator flap attached to said body member at a selectively fixed downward inclination to the forward direction of movement of the body, whereby downward pressure acting on said elevator flap causes said body to submerge as it is propelled in said forward direction by said motor and propellor; and a watertight buoyancy compartment attached to said body member, said compartment being sized so that the bouyancy thereof eventually overcomes said downward water pressure and causes said body member to resurface, whereby the toy or model continually submerges and resurfaces when placed in the water with said elevator flap in said selectively fixed downward inclination and said motor on.

2. A toy as claimed in claim 1 in which the motor is electric.

3. A toy as claimed in claim 1 in which the body is in the shape of a fish.

4. A toy as claimed in claim 1 in which the elevators are in the shape of a pair of fins, one on each side of the body.

5. A toy as claimed in claim 4 in which the fins are mounted one on each end of a rod pivotally mounted in the body and frictionally retained in a preset position.

6. A toy as claimed in claim 5 in which the rod is frictionally retained in position by means of a resilient member which bears against it, the rod and the resilient member having co-operating corrugations on their engaging surfaces.

7. A toy as claimed in claim 2 in which the body is in the shape of a fish.

8. A toy as claimed in claim 3 in which the elevators are in the shape of a pair of fins, one on each side of the body.

9. A toy as claimed in claim 2 in which the elevators are in the shape of a pair of fins, one on each side of the body.

* * * * *